US006032916A

United States Patent [19]

Holliday

[11] Patent Number: 6,032,916

[45] Date of Patent: Mar. 7, 2000

[54] CHRISTMAS TREE SAFETY DEVICE

[76] Inventor: Rick D. Holliday, 139 SW. 14th St., Richmond, Ind. 47374

[21] Appl. No.: 09/070,806

[22] Filed: May 1, 1998

[51] Int. Cl.[7] ..... A47B 97/00; A47B 96/00; B65D 63/00; A44B 1/04

[52] U.S. Cl. ..... 248/505; 248/499; 248/230.8; 24/302

[58] Field of Search ..... 248/499, 317, 248/505, 507, 511, 230.8, 539; 47/42, 43; 24/302, 301, 298, 625

[56] References Cited

U.S. PATENT DOCUMENTS

| | | | |
|---|---|---|---|
| 852,623 | 5/1907 | Roth | 182/7 |
| 964,840 | 7/1910 | Bernau | 431/295 |
| 2,756,693 | 7/1956 | Frost | 410/116 |
| 4,008,669 | 2/1977 | Sumrell | 410/47 |
| 4,579,196 | 4/1986 | Allen et al. | 182/9 |
| 5,131,620 | 7/1992 | Boundy | 248/674 |

*Primary Examiner*—Derek J. Berger
*Assistant Examiner*—David Heisey

[57] ABSTRACT

In its broadest context, the present invention includes a belt with clips at both of its ends. The belt further includes male and female buckle elements slidably secured along the intermediate length of the belt. In use, the clips are secured to an adjacent wall via screws or the like. Thereafter, the buckle elements can be secured to one another thereby creating an intermediate loop of adjustable size. Such intermediate loop is specifically adapted to be formed about an object to be secured, such as a Christmas tree.

1 Claim, 2 Drawing Sheets

CHRISTMAS TREE SAFETY DEVICE

BACKGROUND OF THE INVENTION

1. Field of the Invention

The present invention relates to a safety device and more particularly pertains to a device for securing a Christmas tree to an adjacent wall.

2. Description of the Prior Art

The use of restraint devices are known in the prior art. More specifically, restraint devices are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,307,252 to Croup discloses a wall supported Christmas tree. U.S. Pat. No. 5,341,896 to Amacker discloses a safety harness for tree climbers. U.S. Design Patent 309,359 to Joachim discloses a child safety harness. U.S. Pat. No. 4,923,048 to Cole discloses a safety restraint device. U.S. Pat. No. 4,579,196 to Allen discloses a lineman's safety strap. Lastly, U.S. Pat. No. 5,052,514 to Rexmer discloses a safety harness for hunters.

In this respect, the safety device substantially departs from the conventional concepts and designs of the prior art, and in so doing provides an apparatus primarily developed for the purpose of securing an object to an adjacent wall.

Therefore, it can be appreciated that there exists a continuing need for safer means to mount a Christmas tree. In this regard, the present invention substantially fulfills this need.

SUMMARY OF THE INVENTION

In view of the foregoing disadvantages inherent in the known types of restraint devices now present in the prior art, the present invention provides an adjustable belt for securing an object to an adjacent wall. As such, the general purpose of the present invention, which will be described subsequently in greater detail, is to prevent Christmas trees from falling over and injuring people or property.

To attain this, the present invention essentially comprises a belt with clips at both of its ends. The belt further includes male and female buckle elements slidably secured along the intermediate length of the belt. In use, the clips are secured to an adjacent wall via screws or the like. Thereafter, the buckle elements can be secured to one another thereby creating an intermediate loop of adjustable size. Such intermediate loop is specifically adapted to be formed about an object to be secured, such as a Christmas tree.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved Christmas tree safety device for use in securing a Christmas tree to an adjacent wall. The device includes a nylon belt having a first end and a second end and an intermediate extent therebetween. The first end of the belt is formed into a first loop, and a clip is secured to the distal end of the first loop. The clip is defined by a rounded opened portion and a pivotal closure member secured thereto. The clip is slidably secured to the first loop, and a first slack adjuster formed at the proximal end of the first loop. The slack adjuster functions to adjust the length of the first loop. The device also includes a male buckle element which is slidably secured proximate the intermediate extent of the belt. The male buckle is formed of a pair of resilient insertion members. A female buckle element is also included and is slidably secured proximate the intermediate extent of the belt and proximate the male buckle element. The female buckle is adapted to removably accept the resilient insertion members of the male buckle element. The belt forms an intermediate loop of an adjustable size with the male and female buckle elements are secured to one another. The second end of the belt is formed into a second loop, a clip secured to the distal end of the second loop. The clip has a rounded opened portion and a pivotal closure member secured thereto. The clip is slidably secured to the second loop. A second slack adjuster is formed at the proximal end of the second loop, the slack adjuster functioning to adjust the length of the second loop.

It is another object of the present invention to provide a simple means for preventing Christmas trees from tipping over.

It is a further object of the present invention to provide an adjustable safety belt which can be altered to accommodate various sized objects.

An even further object of the present invention is to provide a safety device which is susceptible of a low cost of manufacture with regard to both materials and labor, and which accordingly is then susceptible of low prices of sale to the consuming public, thereby making such safety devices economically available to the buying public.

Still another object of the present invention is to provide a safety belt constructed from nylon.

Lastly, it is an object of the present invention to provide a new and improved mean s for securing objects to an adjacent wall.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
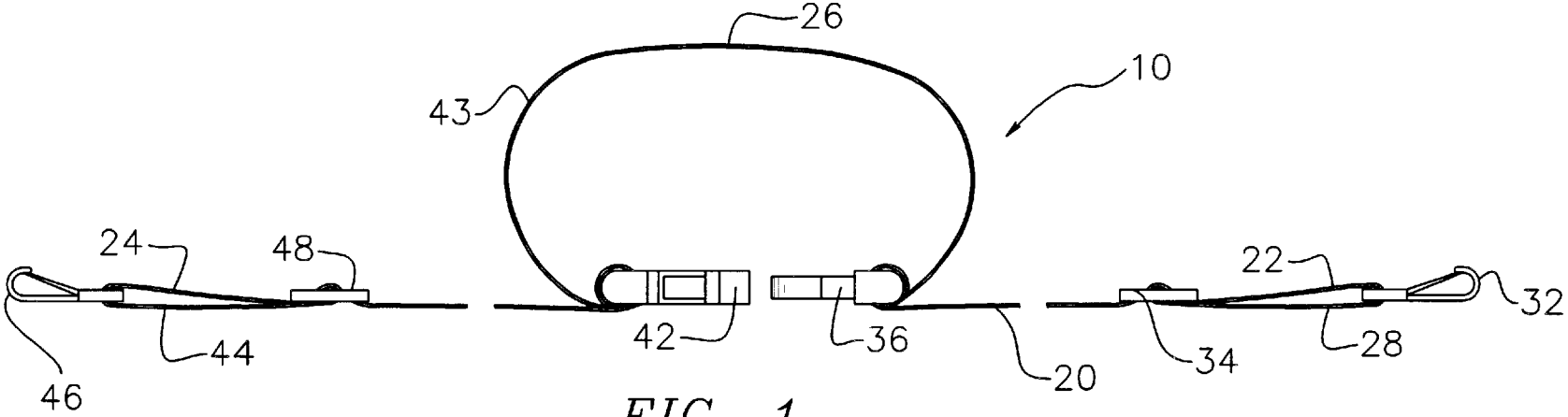
FIG. 1 is a top view of the safety device of the present invention.
Figure 2:
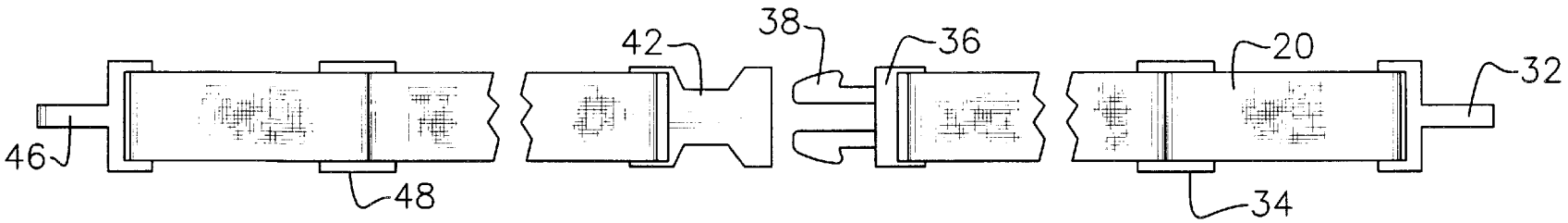
FIG. 2 is a front view of the belt of the present invention.
Figure 3:
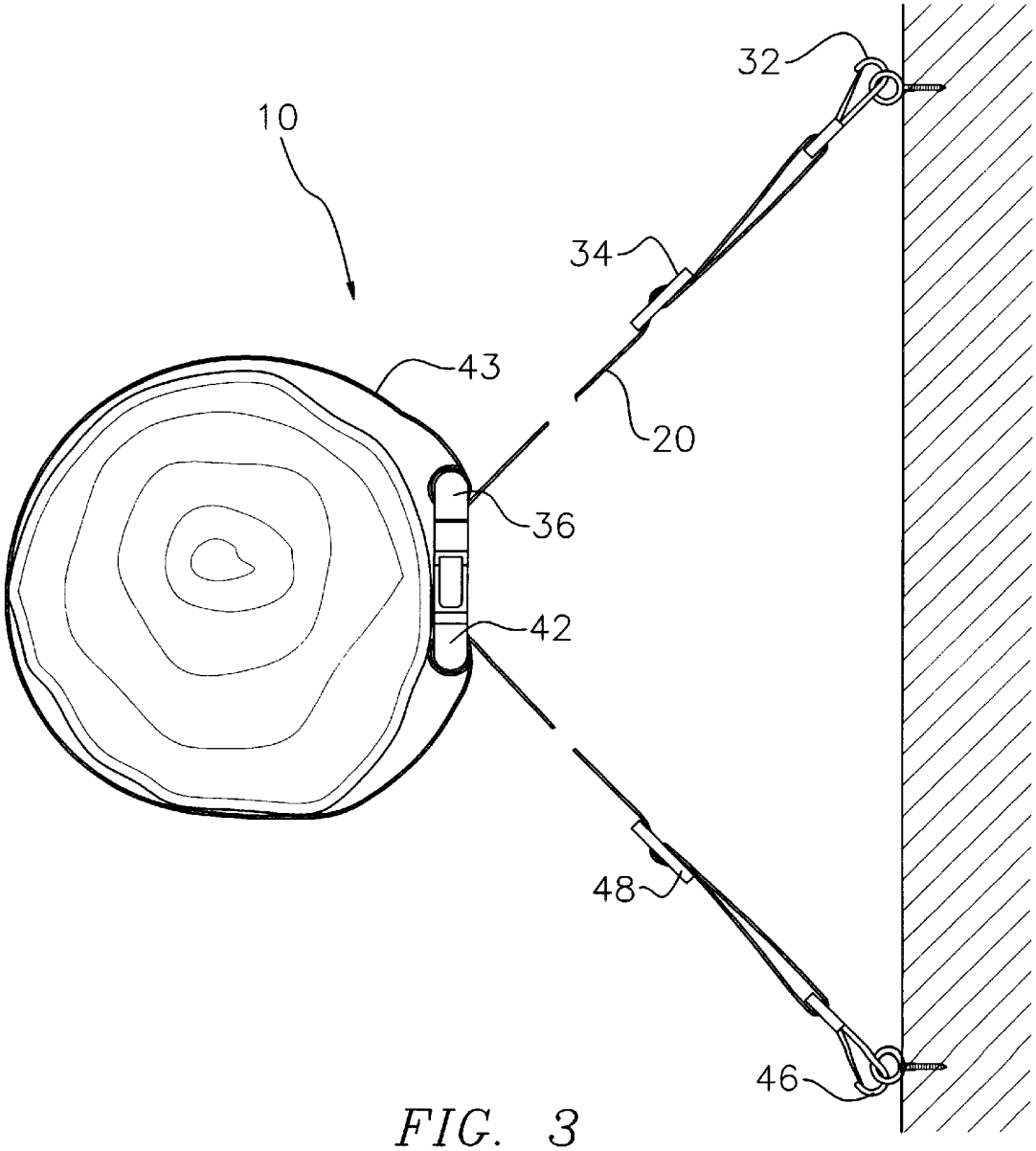
FIG. 3 is a top view of the belt in use, secured about the trunk of a tree.

With reference now to the drawings, and in particular to FIG. 1 thereof, the Christmas tree safety device of the present invention is depicted. In its broadest context, the present invention includes a belt with clips at both of its ends. The belt further includes male and female buckle elements slidably secured along the intermediate length of the belt. In use, the clips are secured to an adjacent wall via screws or the like. Thereafter, the buckle elements can be secured to one another thereby creating an intermediate loop of adjustable size. Such intermediate loop is specifically adapted to be formed about an object to be secured, such as a Christmas tree. The various components of the present invention, and the manner in which they interrelate, will be described in greater detail hereinafter.

The device 10 is primarily formed from a belt 20, preferably formed of nylon. The belt 20 is defined by a first end 22 and a second end 24 and an intermediate extent therebetween 26. As illustrated in FIG. 1, the first end 22 of the belt 20 is formed into a first loop 28, and a clip 32 is secured to the distal end of the first loop 28. The clip 32 has a rounded opened portion and a pivotal closure member secured thereto. Additionally, the clip 32 is slidably secured to the first loop 28. The clip 32 is specifically adapted to be secured to an adjacent wall in a manner which will be described more fully herein. Additionally, a first slack adjuster 34 is formed at the proximal end of the first loop 28. This slack adjuster 34 functions to adjust the length of the first loop 28. More specifically, the slack adjuster 34 slidably accepts both the first end of the belt 20 as well as an adjacent length.

The device 10 also includes a male buckle element 36 which is slidably secured proximate the intermediate extent 26 of the belt 20. The nylon belt 20 is threaded through a lower end of the buckle 36 in a manner which allows the buckle 36 to slidably move along the belt's length. Such buckle element is illustrate with reference to FIG. 1. The male buckle element 36 is formed of a pair of resilient insertion members 38. In a similar fashion, a female buckle element 42 is slidably secured proximate the intermediate extent 26 of the belt and proximate the male buckle element 36. Again, such slidable connection is achieved by threading the belt through the lower portion of the buckle. The female buckle 42 is adapted to removably accept the resilient insertion members 38 of the male buckle element 36. Thereafter, the male buckle 36 may be withdrawn from the female buckle by applying an inward pressure to the sides of the female buckle, and thus pivoting the male elements inward. With the male and female buckle elements secured to one another, an intermediate loop 43 of an adjustable size is formed along the intermediate length 26 of the belt 20. Such loop 43 may be secured about an object to be secured in a manner which will be described in greater detail hereinafter.

The second end 24 of the belt 20 is structurally equivalent to the first end 22. Namely, the second end 24 of the belt 20 is formed into a second loop 44. Additionally, a clip 46 is secured to the distal end of the second loop 44. The clip 46 has a rounded opened portion and a pivotal closure member secured thereto. The clip 46 is slidably secured to the second loop 44. A second slack adjuster 48 is formed at the proximal end of the second loop 44. As with the first adjuster 34, this slack adjuster functions to adjust the length of the second loop 44.

In use, the first and second clips are secured to screws, or other fasteners, within an adjacent wall. Thereafter, the male and female buckle elements are secured around the object to be secured. Sine each buckle is slidably secured along the length of the belt, objects of various sizes can be accommodated. Additionally, the two slack adjusters can be manipulated to alter the length of the belt. Thus, the slack adjusters can accommodate objects which are closer or most distant from the adjacent wall.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the united states is as follows:

1. In combination, a safety device which secures a Christmas tree having a trunk to an adjacent wall comprising:

a nylon belt having a first end and a second end and an intermediate extent therebetween, the first end of the belt being formed into a first loop, a clip secured to the distal end of the first loop, the clip having a rounded opened portion and a pivotal closure member secured thereto, the clip being slidably secured to the first loop, a first slack adjuster formed at the proximal end of the first loop, the slack adjuster functioning to adjust the length of the first loop;

a male buckle element being slidably secured proximate the intermediate extent of the belt, the male buckle being formed of a pair of resilient insertion members;

a female buckle element being slidaby secured proximate the intermediate extent of the belt and proximate the male buckle element, the female buckle adapted to removably accept the resilient insertion members of the male buckle element, the belt forming an intermediate loop of an adjustable size positionable around the trunk of the Christmas tree with the male and female buckle elements are secured to one another;

the second end of the belt being formed into a second loop, a clip secured to the distal end of the second loop, the clip having a rounded opened portion and a pivotal closure member secured thereto, the clip being slidably secured to the second loop, a second slack adjuster formed at the proximal end of the second loop, the slack adjuster functioning to adjust the length of the second loop, the first and second ends of the belt being coupled to the adjacent wall with the belt forming an obtuse angle.

* * * * *